US005471936A

United States Patent [19]

Kemnitz

[11] Patent Number: 5,471,936

[45] Date of Patent: Dec. 5, 1995

[54] FURNITURE ASSEMBLY COMPONENTS

[75] Inventor: Glen Kemnitz, Gallatin, Tenn.

[73] Assignee: Sunbeam Corporation, Fort Lauderdale, Fla.

[21] Appl. No.: 104,803

[22] Filed: Aug. 10, 1993

[51] Int. Cl.[6] ..... A47B 3/06

[52] U.S. Cl. ..... 108/157; 108/27

[58] Field of Search ..... 108/157, 158, 108/159, 153, 156, 27

[56] References Cited

U.S. PATENT DOCUMENTS

| | | | |
|---|---|---|---|
| 3,561,376 | 2/1971 | Knoblock | 108/157 X |
| 3,643,608 | 2/1972 | DeCesaris | 108/157 |
| 4,003,320 | 1/1977 | Owens et al. | 108/157 |
| 4,299,423 | 11/1981 | Saiger . | |
| 4,315,467 | 2/1982 | Vanderminden | 108/157 |
| 4,324,433 | 4/1982 | Saiger . | |
| 4,754,714 | 7/1988 | Drumm | 108/157 |
| 4,805,541 | 2/1989 | Drane et al. | 108/157 X |
| 4,905,612 | 3/1990 | Apissomian | 108/157 |

*Primary Examiner*—José V. Chen
*Attorney, Agent, or Firm*—Michael J. Kline; Carol I. Bordas; Darren E. Wolf

[57] ABSTRACT

Components for assembling furniture, particularly wrought iron tables. The components include a structure for attaching furniture legs to the main body of the furniture, an apparatus for affixing a glass or other insert into a furniture top, and a member for reducing noise caused by flexing in the furniture top, or in the case of an insert, a member for cushioning and supporting the insert.

16 Claims, 3 Drawing Sheets

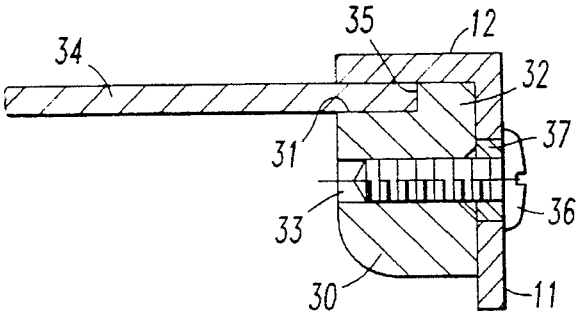
FIG. 1(c)
FIG. 1(d)
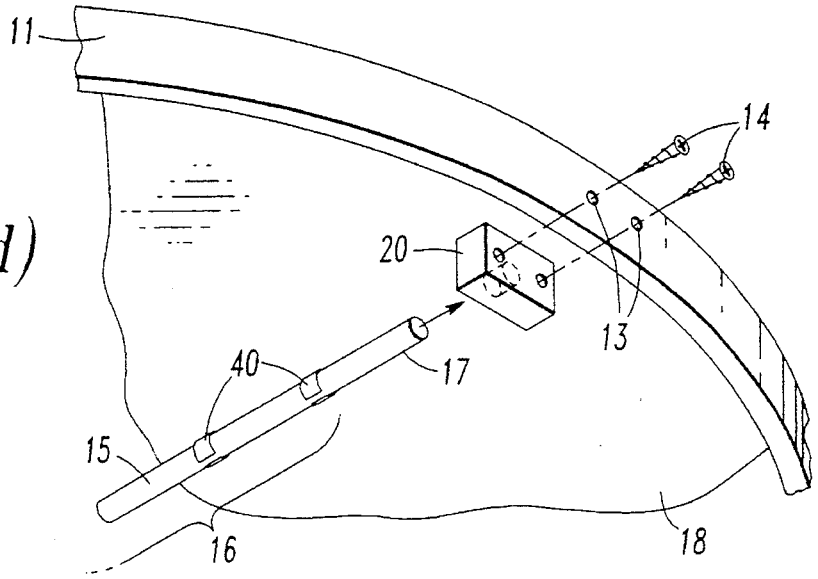
FIG. 2(a)
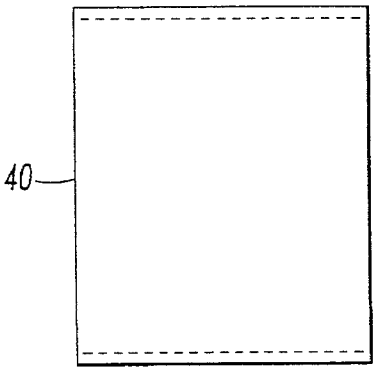
FIG. 2(b)
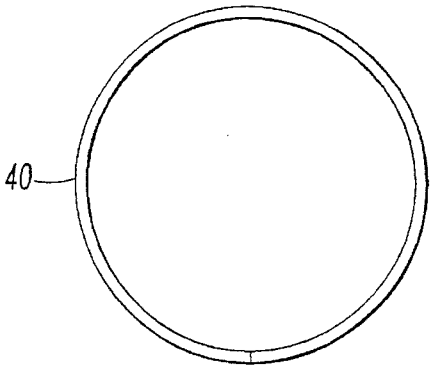

FIG.3(a)
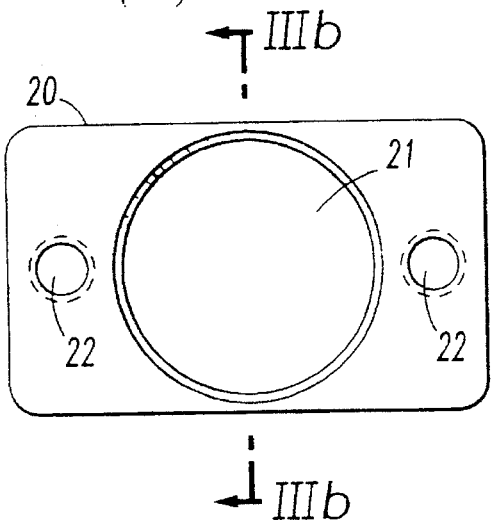
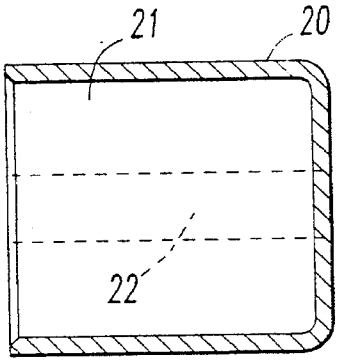
FIG.3(b)
FIG.4(b)
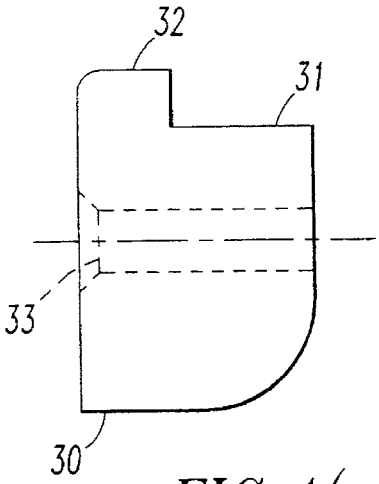
FIG.4(a)
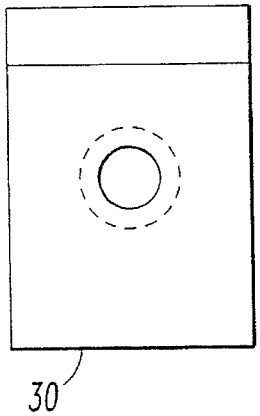

FURNITURE ASSEMBLY COMPONENTS

FIELD OF THE INVENTION

The present invention relates to furniture. More specifically to tables and even more particularly to wrought iron tables such as those comprising outdoor furniture.

BACKGROUND OF THE INVENTION

Furniture is not carved from a single block of wood or made in a single casting of metal. Instead it is made by interconnecting a plurality of component parts. The present invention concerns novel components to aid in assembling these parts. Nearly all furniture has legs which elevate a portion of the furniture which is of interest to a more convenient level. Although it is possible to construct a piece of furniture with a single leg unit, in practice there are usually two or more such units to support the piece of furniture.

Furniture is usually manufactured and shipped as separate components and later assembled by the ultimate consumer. In the case of tables, the table top is often attached to a frame assembly or to a rim. Generally, when a frame assembly is used, it is located underneath the table top and provides support and rigidity thereto. A rim is normally located around the perimeter of the table top. The legs typically reach the table top near the center and run radially from that point to the rim. This radial portion supports the table top and gives it rigidity.

Regardless of which support method is used, it is necessary to attach the legs to either the frame assembly or the rim. One approach used to secure the legs to the table top is to weld a threaded stud to the frame assembly or to the rim. A second bracket is attached to the furniture leg. This second bracket fits around the threaded stud and a nut is used to tighten the two pieces together.

There are several disadvantages to this design. The first is the extra manufacturing steps required to attach the threaded studs and corresponding brackets to the component parts. Second, since threaded studs are integrated into one or more component parts, additional steps need to be taken to protect the threads from paint dust during the painting process. If the threads are not protected during the process of painting the components, paint dust will settle in the threads and harden, rendering the threads useless. This protection often takes the form of coating the threads with plastic. This coating, however, necessitates either an additional manufacturing step to remove the plastic or leaving the plastic in the threads for the ultimate consumer to attempt to remove during assembly. In any case, before assembly the plastic must be removed because it fills the threads and prevents the nut from turning.

An older design uses legs with a "Y"-shaped upper portion which are inserted into a "U" bracket which is welded to the rim or frame assembly. The "Y"-shaped upper portion of the legs are designed to be slightly too wide to fit into the "U" bracket and therefore, prior to inserting them they must be compressed. Thereafter the legs are held in the "U" bracket under compression. This design makes assembly difficult and requires both strength and coordination on the part of the assembler.

Yet another known design uses friction to hold the leg into the table rim. In this design the rim has a "C" shaped cross-section with the opening facing inward. The top portion of the table leg is wedged into the opening. This design allows for a simpler manufacturing process, but does not provide a solid assembly.

The final known design welds or otherwise integrates a threaded hole into the top of the leg. A corresponding hole in the rim allows the table top to be attached to the leg. Although this allows for easy assembly because the threaded hole is integrated into one of the component parts, the threads necessitate an additional manufacturing step to protect them during the painting process. If a coating is used to protect the threads then an additional step to remove the plastic is required.

It is not unusual for a piece furniture to have a glass insert. Most designs do not secure the glass into the furniture, but instead provide a support and allow the glass insert to be held onto the support by gravity. In the event that the furniture is knocked on its side, the glass insert will fall out and perhaps shatter. The only known design which secures the glass insert into the furniture involves the use of horizontal ridges on the top of the furniture legs which support the glass. A rim piece goes around the edge of the glass insert and holds it down against the leg supports. The rim is attached to the legs with screws running through holes in the rim and into threaded holes in the legs. As discussed above, these threaded holes must be protected from paint dust when the component parts are being painted, and thus require at least one additional manufacturing step.

There is no known prior art which provides cushioning support for the glass insert in the event a heavy object is dropped on the glass or in the event that the table is knocked over.

Finally, there is no known prior art to reduce the noise caused when the table top flexes and contacts the rigid support frame.

SUMMARY OF THE INVENTION

The present invention is an improved piece of furniture. The invention consists of improved means for attaching the legs of the furniture to the top portion of the furniture. The attachment means is affixed to both the rim of the table top and the upper portion of the furniture leg, effectively binding the two pieces together.

The invention also consists of a novel spacer which is a support and noise suppression component for flexible furniture tops. This component is located between the table top and the upper portion of the furniture leg which supports the table top. The spacer prevents the table top from directly contacting the rigid components which support the table top, thus reducing the resulting sound. In the preferred embodiment, the spacer is made from a resilient material which acts as a cushion when the table top contacts the rigid support components. This feature is particularly applicable when a frangible table top or insert, such as glass, is used.

Finally, the invention consists of an improved support bracket to secure a glass or other insert into a furniture top. In the preferred embodiment the support bracket also acts as a cushion to protect the insert in the event a heavy object is dropped on the insert or the piece of furniture is knocked onto its side.

It is an object of the present invention to reduce the number of manufacturing steps and therefore reduce the manufacturing cost while at the same time producing a better product. This object is accomplished through the use of easy-to-manufacture components which are not integrated into the furniture but which still allow for easy assembly.

BRIEF DESCRIPTION OF THE DRAWINGS

FIG. 1(*b*) is a side elevational view of a presently preferred embodiment of an assembled table.

FIG. 1(*c*) is a sectional view of the glass support bracket as it appears in the preferred embodiment of the assembled table of FIG. 1(*b*). The depiction is upside down.

FIG. 1(*d*) is a partial, exploded perspective view of the table rim connector as it appears in the preferred embodiment of the assembled table of FIG. 1(*b*).

FIG. 2(*a*) is a side elevational view of the table top spacer as it appears in the preferred embodiment of the assembled table shown in FIG. 1(*b*).

FIG. 2(*b*) is a front elevational view of the table top spacer shown in FIG. 2(*a*).

FIG. 3(*a*) is a front elevational view of the leg connector of the preferred embodiment of the assembled table shown in FIG. 1(*b*).

FIG. 3(*b*) is a sectional view of the leg connector shown in FIG. 3(*a*) taken along line IIIb—IIIb.

FIG. 4(*a*) is a side elevational view of the glass support bracket as it appears in the preferred embodiment of the assembled table shown in FIG. 1(*b*).

FIG. 4(*b*) is a back elevational view of the glass support bracket shown in FIG. 4(*a*).

DETAILED DESCRIPTION OF THE PREFERRED EMBODIMENTS

Figure 1A:
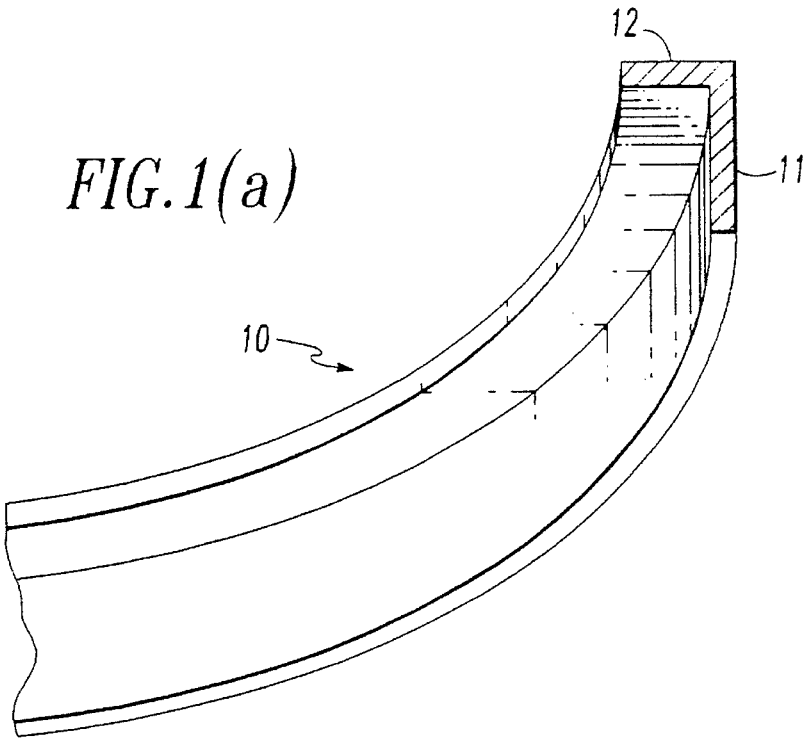
FIG. 1(*a*) is a perspective view having a cut-away section of the table rim as it appears in the preferred embodiment.
Figure 1B:
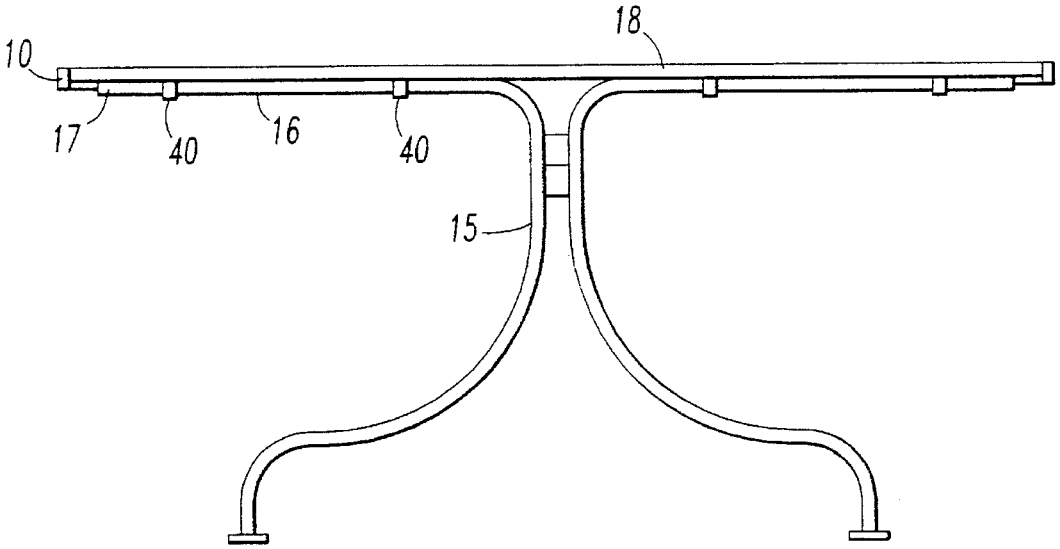

Referring to FIG. 1(*a*) and 1(*b*), the invention relates to a piece of furniture having a top portion 18 with a rim, generally 10, and a number of leg portions generally 15. The rim has an angled cross-section with a generally vertical component 11 and a generally horizontal component 12. In a present preferred embodiment, the leg, generally 15, has a support portion, generally 16, with an end portion 17. The support portion 16 has one or more table top spacers 40. The spacers 40 serve two purposes. First, because of the non-rigid qualities of the material comprising the spacers 40 they provide cushioned support for the table top 18. Second, in the case where manufacturing variances leave a gap between the table top 18 and the support portion 16, these same qualities reduce the noise caused by the table top 18 flexing and contacting the support portion 16. This flexing can be caused by placing a heavy object on the table top 18. The spacer 40 is shown in detail in FIGS. 4(*a*) and 4(*b*). Without the spacers, when the table top 18 flexes it will contact the rigid support 16 and make noise.

The spacers 40 can be made of almost any extrudable or moldable resin. The spacers 40 are preferably made of resilient materials such as PVC, polyethylene, and moldable rubber. Almost any non-rigid material will yield the noise-reduction quality in the spacers 40, but only materials with at least some degree of resiliency will retain the cushioning quality.

A second aspect of the invention involves the leg connector 20. As shown in detail in FIGS. 3(*a*) and 3(*b*) the leg connector, generally 20, comprises an opening 21 for accepting the end portion of the table support 17. In addition, the leg connector 20 has two threaded holes 22. As shown in FIG. 1(*d*) the threaded holes 22 correspond to holes in the vertical component of the rim 13, and with the use of two screws 14 are the means by which the connector 20 is attached to the rim 10. The leg connector 20 can be made of almost any injection moldable plastic. Materials such as nylon, polycarbonates, and acrylonitrile/butadiene/stryrene (A.B.S.) are preferred because they endure hot and cold temperatures without becoming brittle. In addition, they possess sufficient strength to be used with self-threading screws, if such an attachment means is desired. These materials, however, are not necessary to yield the advantages of ease of assembly or reduced manufacturing cost. It is also contemplated that the leg connector 20 can be attached to the rim 10 by other means such as adhesive or the use of a screw and nut combination without threaded holes. The present invention is superior to the prior art because it allows for easy assembly without any pressure or compression fitting of parts. In addition, the manufacturing process is simplified because the leg connector 20 is not permanently attached to the furniture and therefore the threaded portion 22 is not present during the painting process.

Another aspect of the present invention relates to the insertion of glass or other items into the table top 18. The glass support bracket 30, shown in detail in FIGS. 4(*a*) and 4(*b*), comprises a flat surface 31, a ridge 32, and a threaded hole 33. As shown in FIG. 1(*c*) the flat surface 31 traps the glass between the bracket 30 and the horizontal component of the rim 12. The ridge 32 separates the edge of the glass insert 35 from the vertical component of the rim 11. The threaded hole 33 corresponds to a hole 37 in the vertical component of the rim 11 and with the use of the screw 36 attaches the glass support bracket 30 to the rim 10. In additional to immobilizing the glass insert 34, in the preferred embodiment the glass support bracket 30 also cushions the glass insert 34 in the event a heavy object is dropped on the table or the table is knocked on to its side. Although the glass support bracket 30 can made of almost any injection moldable plastic, materials such as nylon, polycarbonates, and acrylonitrile/butadiene/stryrene (A.B.S.) are preferred in order to retain the cushioning benefit to the insert. In addition, these materials possess sufficient strength to be used with self-threading screws, if such an attachment means is desired.

Although the invention has been described in detail in the foregoing for the purpose of illustration, it is to be understood that such detail is solely for that purpose, and that variations can be made without departing from the spirit and scope of the invention as defined by the following claims. All such variations are specifically intended to be embraced within the scope of the following claims, including all equivalents thereof.

We claim:

1. A table comprising:

(a) a table top having a rim with a shape defined by the perimeter of said table top, said rim having a vertical wall;

(b) at least one leg having an upper portion to support said table top, said upper portion terminating at an end which is proximate said rim; and (c) an attachment means for attaching said upper portion of said leg to said rim, said attachment means including an opening for accepting said end of said upper portion of said leg and a means for attaching said attachment means to said vertical wall of said rim, wherein said attachment means directly engages said vertical wall of said rim.

2. The table of claim 1, wherein said attachment means is made from a material selected from the group consisting of nylon, polycarbonates, and A.B.S.

3. The table of claim 1, further comprising at least one table top spacer located on said upper portion of said leg with at least a portion of said table top spacer located between and separating said upper portion of said leg and said table top.

4. The table of claim 3, further comprising (a) a table top insert fitting within said rim;

(b) a support bracket for securing said table top insert to said rim, wherein said support bracket comprises a means for attaching said support bracket to said vertical wall of said rim and a means for securing said table top insert against a horizontal wall of said rim while at the same time cushioning said table top insert with respect to said vertical wall of said rim.

5. The table of claim 3, wherein said table top spacer is made from a material selected from the group consisting of PVC, polyethylene, and moldable rubber.

6. The table of claim 1 wherein said attachment means is a substantially rectangular, solid body having at least one recess for receiving said means for attaching the attachment means to said vertical wall, and wherein said opening is a cavity in the center of said rectangular body for receiving said at least one leg such that said attachment means surrounds said at least one leg.

7. A table comprising:

(a) a table top having a rim with a shape defined by the perimeter of said table top, said rim having a vertical wall;

(b) at least one leg having an upper portion to support said table top, said upper portion terminating at an end which is proximate said rim: and (c) an attachment means for attaching said upper portion of said leg to said rim, said attachment means including an opening for accepting said end of said upper portion of said leg and a means for attaching said attachment means to said vertical wall of said rim, wherein said attachment means is a substantially solid body engaging said vertical wall of said rim, and wherein said means for attaching said attachment means extends through both said vertical wall and said solid body.

8. A table comprising:

(a) a table top having a rim with a shape defined by the perimeter of said table top and having a glass insert fitting within said rim, said rim having both a horizontal and a vertical wall; and (b) a support bracket for securing said glass insert to said rim wherein said support bracket comprises a means for attaching said support bracket to said vertical wall of said rim and a means for securing said glass insert against said horizontal wall of said rim while at the same time cushioning said glass insert from said vertical wall of said rim, and wherein said means for attaching said support bracket to said vertical wall extends through both said support bracket and said vertical wall.

9. The table of claim 8 wherein said support bracket is made from a material selected from the group consisting of nylon, polycarbonate, and A.B.S.

10. The table of claim 8 wherein said attaching means fixedly attaches said support bracket to said vertical wall such that said support bracket is fixed with respect to said vertical wall.

11. A table comprising:

(a) a table top having a rim with a shape defined by the perimeter of said table top and having a glass insert fitting within said rim, said rim having both a horizontal and a vertical wall;

(b) a support bracket for holding said glass insert to said rim wherein said support bracket comprises a means for attaching said support bracket to said vertical wall of said rim and a means for securing said glass insert against said horizontal wall of said rim while at the same time cushioning said glass insert from said vertical wall of said rim;

(c) at least one leg having an upper portion to support said table top, said upper portion terminating at an end which is proximate said rim;

(d) an attachment means for attaching said upper portion of said leg to said rim, said attachment means including an opening for accepting said end of said upper portion of said leg and a means for attaching said attachment means to said vertical wall of said rim, wherein said attachment means directly engages said vertical wall of said rim; and (e) at least one table top spacer located on said upper portion of said leg with at least a portion of said table top spacer located between and separating said upper portion of said leg and said table top.

12. The table of claim 11 wherein said means for attaching said support bracket to said vertical wall fixedly position said support bracket in direct engagement with said vertical wall.

13. The table of claim 11 wherein said attachment means is a substantially rectangular, solid body having at least one recess for receiving said means for attaching the attachment means to said vertical wall, and wherein said opening is a cavity in the center of said rectangular body for receiving said at least one leg such that said attachment means surrounds said at least one leg.

14. The table of claim 11 wherein said at least one table top spacer is a hollow member which surrounds said upper portion of said at least one leg.

15. The table of claim 14 wherein said table top spacer is cylindrical and is divided along the length forming two edges such that said two edges of said table top spacer can be separated in order to position said table top spacer around said upper portion of said at least one leg.

16. The table of claim 11 wherein said means for attaching said support bracket to said vertical wall extend through both said vertical wall and said support bracket, and wherein said means for attaching said attachment means to said vertical wall extend through both said vertical wall and said attachment means.

* * * * *